United States Patent [19]

Conviser

[11] 4,434,696

[45] Mar. 6, 1984

[54] INSTRUMENT FOR COMPARING EQUAL TEMPERAMENT AND JUST INTONATION

[76] Inventor: Harry Conviser, 1335 Woodruff Ave., Los Angeles, Calif. 90024

[21] Appl. No.: 323,682

[22] Filed: Nov. 20, 1981

[51] Int. Cl.[3] ..... G10H 5/07

[52] U.S. Cl. ..... 84/1.01; 84/DIG. 11; 328/16; 328/17; 331/51

[58] Field of Search ..... 84/1.01, 445, 454, DIG. 11, 84/DIG. 18, DIG. 23; 328/16–18; 364/703; 331/51

[56] References Cited

U.S. PATENT DOCUMENTS

| | | | |
|---|---|---|---|
| 3,590,131 | 6/1971 | Reyers | 84/DIG. 11 |
| 3,795,754 | 3/1974 | Mochida | 84/1.01 |
| 3,809,787 | 5/1974 | Mochida | 84/1.01 |
| 4,256,008 | 3/1981 | Ryon | 84/454 |

*Primary Examiner*—Stanley J. Witkowski

[57] ABSTRACT

Equal-ratio scales offer a choice of semitone accuracies ranging from a thousandth cent to a millionth of a cent, any note of which may be selected as a reference for a fully chromatic just-intonation scale whose ratios are absolute and may be modulated in all 15 tonalities, i.e., to signature keys in seven sharps and seven flats.

12 Claims, 18 Drawing Figures

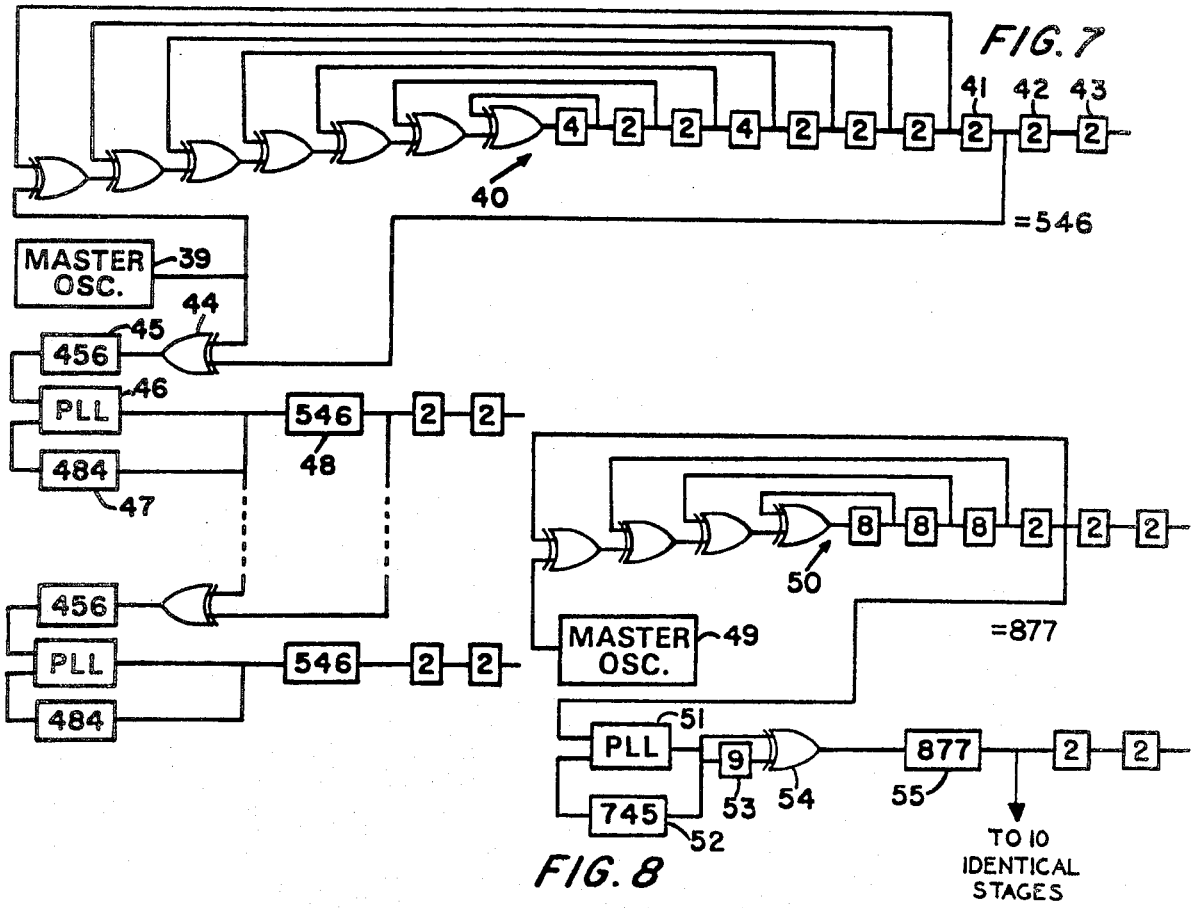
FIG. 8
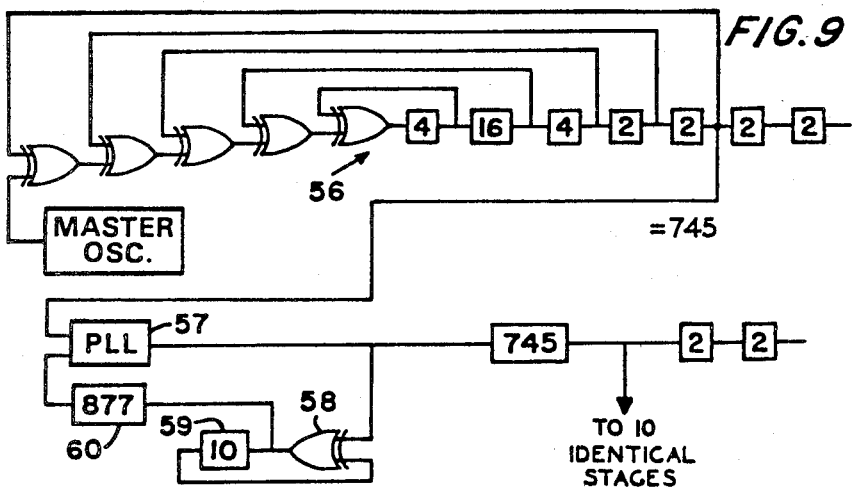

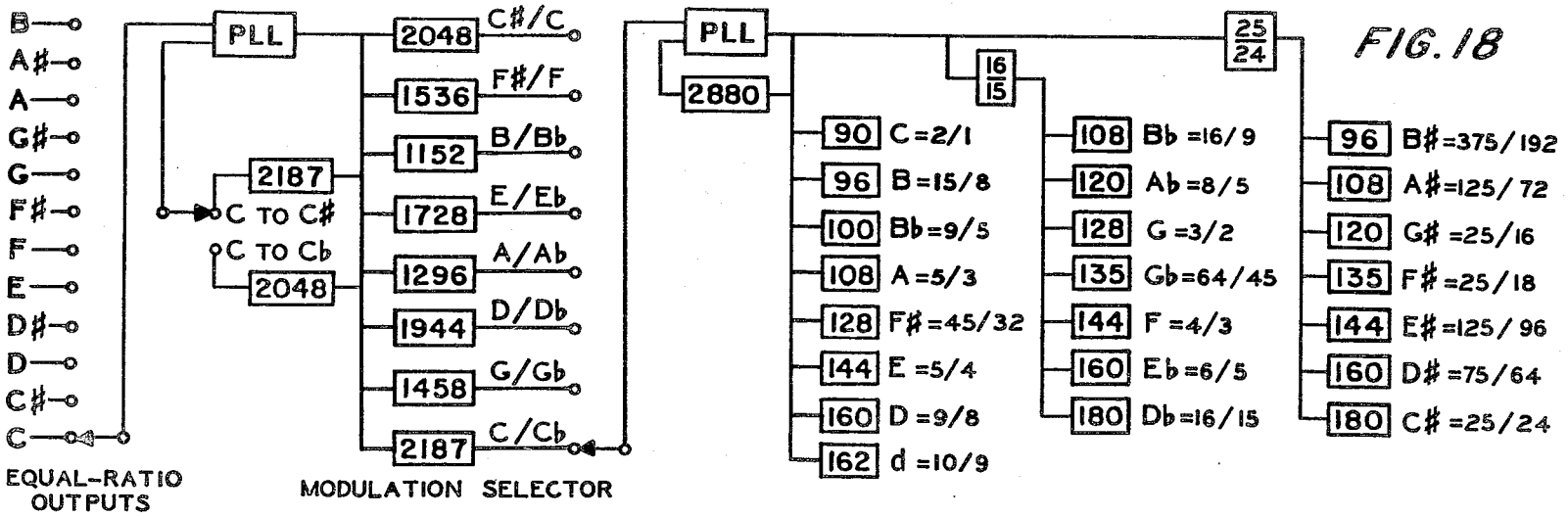
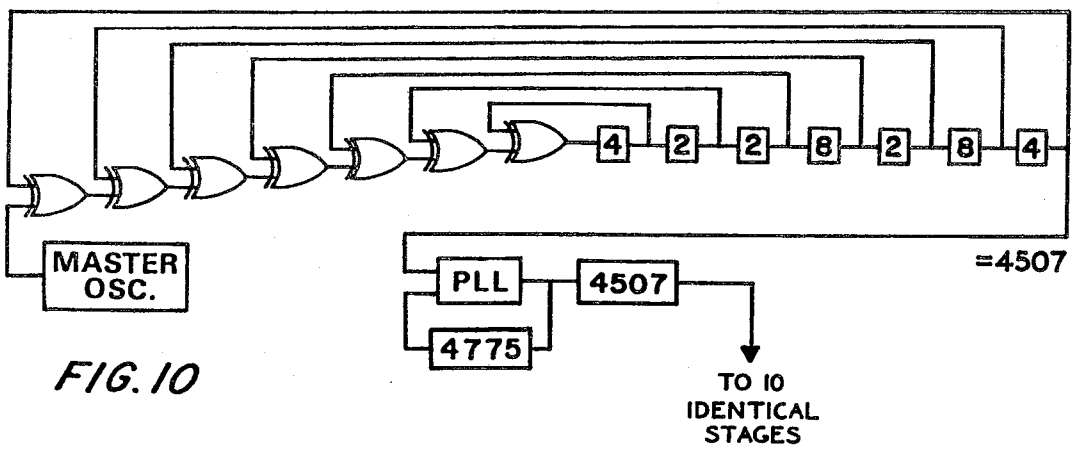
FIG. 10

INSTRUMENT FOR COMPARING EQUAL TEMPERAMENT AND JUST INTONATION

BACKGROUND OF THE INVENTION

Both equal temperament and just intonation have heretofore been held to be ideal scales that could not be precisely attained in practice. Although the principle of equal temperament has become firmly established in the last 300 years as the standard for musical intonation, few, if any, skilled musicians abide by it, and mechanical instruments, due to inherent physical limitations, cannot maintain it. Hence the assignment of equal intervals, its historical argument for providing freedom of modulation to other tonalities, or signature keys, has no basis in reality.

In the study as well as in the performance of music no subject matter has been more controversial than the centuries-old dispute regarding tempered scales and just intonation. A current example of their tonal differences may be observed in viewing a piano or organ keyboard, where, for instance, C♯ and D♭ are represented by the same black digital, or manual key, although these notes are written in musical notation as two separate and distinct notes. Moreover, depending upon the tonality, or signature key, in which a musical composition is written, certain white digitals are on occasion assumed to be sharps or flats.

Similar discrepancies of so-called "enharmonic notes," which harmony textbooks describe as being "practically" the same note, exist in virtually all other fixed-frequency instruments, whether plucked or blown, although skilled performers manage to modify the frequency, or "pitch," slightly to bring a note "into tune," generally to conform to a predominating tone, or in consonant relation thereto, when performing with other instruments. Thus a good deal of a performer's artistry depends upon an ability to make perceptible corrections in frequency, where possible. This is part of a learning process. (See, for example, "Intervals, Scales & Temperaments," by Llewellyn S. Lloyd and Hugh Boyle, St. Martin's Press, New York, 1979, pp. 280–286.)

No less significant, but generally overlooked, is the fact that when modulation, or transition to other tonalities, is called for in written music, several of the notes of one tonality require small but distinct changes in frequency for the same nominal, or written, notes of the previous tonality. These changes are known as "syntonic commas," or ratios of 81/80 for each increasing number of sharps and 80/81 for every added flat in the key signatures. Whereas equal temperament is based on two intervals, a semitone and a whole tone equal to two semitones, just intonation has three basic diatonic intervals: a semitone (16/15), a minor tone (10/9) and a major tone (9/8). Moreover, C♯ has a ratio of 25/24, but D♭ is 16/15.

For centuries numerous scholars and critical listeners have argued that the influence of fixed-pitch instruments have contributed to a loss of correct pitch and has caused vocalists and instrumentalists not constrained by fixed pitch to sing and play "out of tune" either for equally tempered or "just" performance. Basic to this problem has been the lack of technological development in instruments for either tempered tuning or just intonation. An examination of the abundant literature on the subject discloses that no fixed-pitch or keyboard instruments have previously been proposed or built capable of approaching precisely equal tempered intervals, nor any that could accurately produce just intonation and all of its enharmonic notes or modulational pitch changes for either instructional or performance use.

The degree of perfection implied by the term "equal temperament" was first shown in 1595 by the Chinese prince Chu Tsai-yu, whose recorded monochord string lengths show no greater semitone error than two-millionths cent when converted into present-day logarithmic calculations of 12 equal semitones totaling 1200 cents, or 100 cents for each semitone. Yet the tuning of pianos and organs has seldom yielded accuracies of better than two cents.

Just intonation, as applied to the development of harmonic needs, has not been so well defined, although the precise diatonic interval relationships were clearly given by Claudius Ptolemy in about 200 A.D. More than a millennium passed before flats were firmly established in music, and sharps appeared in the 17th-Century emergence of opera as an artistic form. These so-called "accidentals" in the historical progression from strictly melodic to freely harmonic music led to many compromise scale systems, but these invariably fell short of meeting either tonal needs or playable keyboards.

Helmholtz, in his monumental treatise, "On the Sensations Of Tone As A Physiological Basis For The Theory Of Music," translated by A. J. Ellis and published in 1875 by Longmans, Green & Co, London, gave his appraisal of the practicability of just intonation in a keyboard instrument, when he said (p.491): "... In order to obtain perfect intervals in all keys, it would certainly be scarcely possible to overcome the difficulties of the problem." Regarding specific keyboards, Helmholtz reported (p. 499) that Praetorius, a 17th-Century annotator, had seen in Prague an instrument having 19 digitals to the octave, "the black digitals being doubled, and others inserted between those for e and f, and between those for b and c," but the tuning was applied to an improved temperament, not to a just-intonation scale.

All of the known proposals for solving the tonal or keyboard problems were merely reflections of what one or another inventor thought to be adequate for representing written music correctly. (See, for example, "Enharmonic Key-Board for Organs & c" of H. W. Poole, U.S. Pat. No. 73,753, for scales "in every key or signature.") The efforts of numerous innovators gave rise to other intervals anomalous to the Ptolemaic relationships (i.e., those variously referred to as natural, exact, right, pure, true, correct, or just), some of them based on extensions of the harmonic series of a single tone, others upon a variety of "cyclic" approximations and still others on Pythagorean (3/2-related) ratios, which last properly apply to modulation but not to just-intonation intervals within a single tonality as perceived by the ear in harmony or in chordal relationships.

In more recent years just intonation has become largely a curiosity as well as a perplexity to music students who were taught the differences of enharmonic notes, were asked to disregard them for purposes of studying harmony, and yet were expected to produce the correct intonation on instruments not constrained by fixed pitch, or in singing. Such instrumentalists and vocalists have been accused of false intonation when their pitch did not exactly correspond to a fixed-pitch instrument, however incorrectly tuned. Moreover, modulaton, as a transition to a related tonal center, has been reduced to a form of fixed, keyboard-note transposition as dictated by the tuning of an equally tempered scale of questionable accuracy.

Significantly, just intonation was taught as a system in sight-reading of mucic to English schoolchildren by means of a movable-Do method of modulation known as Tonic Sol-fa, introduced by Sarah Ann Glover in the early 19th Century and developed by John Curwen into a national movement. (See "Tonic Sol-fa," Encyclopedia Britannica, Vol. 22, pp. 283–284, 1958.) By contrast, the Solfeggio system, taught in music schools and conservatories, used a fixed-Do method, an outgrowth, particularly in Italy and France, of the influence of fixed-pitch instruments, dating from the 18th Century. Its stated purpose was to encourage the development of pitch memory in the teaching of sight-singing to conform with tempered tuning.

DESCRIPTION OF THE PRIOR ART

The development of the electronic arts, and particularly the availabiity of integrated-circuit modules, brought forth numerous proposals for obtaining a variety of approximations of the equally tempered scale by utilizing a master oscillator, or clock frequency, followed by a number of integer dividers, singly or in combination with rate scaling or summing circuits, other pulse modifying methods, etc. Some of these systems were illustrated and described in U.S. Pat. No. 3,816,635, granted to Dale M. Uetrecht, who properly explained the preference of not using high master-oscillator frequencies, and summarized the limitations and errors of each system. None gave the required equal-ratio semitone to any reasonable degree of accuracy, but rather distributed the rough approximations randomly within the octave; some directly, others through additive methods designed to lessen the errors, or, in the extreme case, to make use of such errors for obtaining special effects.

Relatively few electronic-art innovations have appeared in the field of just intonation. Several proposals were made for a decreased number of tones, or for modifying the intervals of the just diatonic scale and its accidentals, or in different arrays of manual keys requiring other than the standard-key spacings, thus requiring unusual fingering. Another system (U.S. Pat. No. 3,601,518), for a limited just-intonation scale, would use "controlled period multipliers" from an unreasonably high clock frequency of 68 MHz. Still another (U.S. Pat. No. 3,871,261) proposed a 12-tonality 12-tone "true"-intonation instrument that would be switched from the tempered scale by "modifier" means, such as diode matrices, requiring 12 biasing potentiometers for each of 12 manually tunable L-C oscillators, for a total of 156 tones, including tempered, to be adjusted within the octave.

U.S. Pat. No. 3,939,751 described presettable, or so-called "programmable," integer dividers for approximate selection, to an accuracy of one cent, of less than full just-intonation intervals for study purposes, utilizing two separate keyboards, but made no provision for modulation of the selected intervals from the signature key of C to any other tonalities.

BRIEF DESCRIPTION OF THE DRAWINGS

FIG. 7 is a block diagram containing octave dividers as part of a compound-ratio divider.

FIG. 8 is a block diagram of an octave divider serving as direct divider in a compound-ratio system, for a descending scale.

FIG. 9 is a block diagram reversing two ratios of the compound dividers of FIG. 8 to obtain an ascending scale.

FIG. 10 is a block diagram of a large prime number resolved into a divider serving also for octave division.

FIG. 18 shows the interconnections of the equal-ratio outputs and the modulation selector, the modulation dividers and the just-intonation dividers for providing scales in all 15 tonalities.

DETAILED DESCRIPTION OF THE INVENTION

Figure 1:
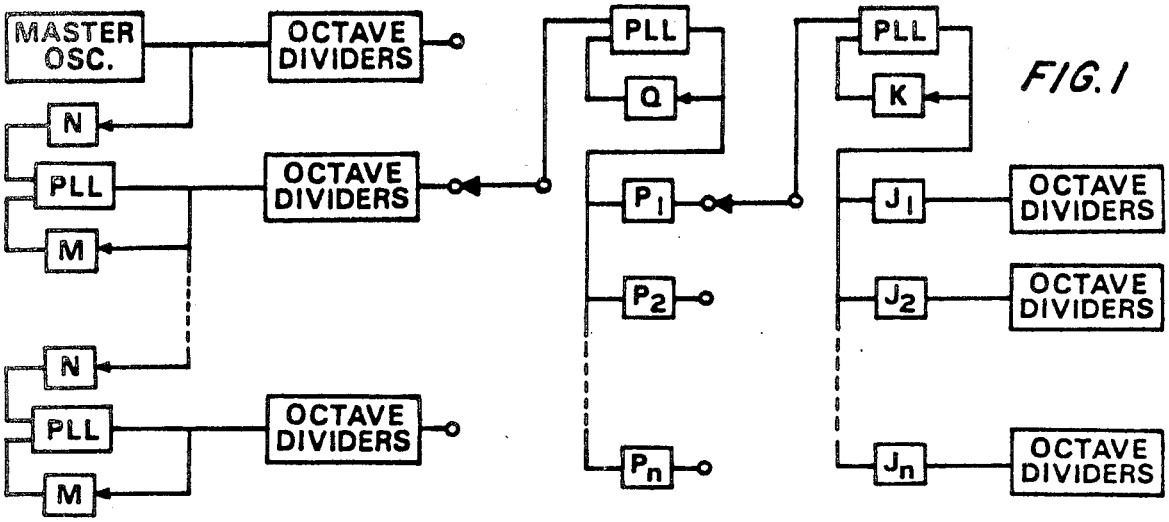
FIG. 1 is a condensed block diagram of the several and separate functions combined in an embodiment of the invention.

In FIG. 1 a master-oscillator supplies a primary reference frequency to a modulo-N counter used as a frequency divider, shown as N, whose divided frequency serves as the input signal to a phase-locked loop, or PLL, having an output frequency controlled by a second Modulo-M counter used as a frequency divider, M, which operates as a multiplier in the feedback circuit of the phase-locked loop, thus establishing a ratio of M/N for the two outputs, namely the ratio of the PLL output to the master oscillator output. A series of similar M/N stages, to make up a total of 12 outputs, when coupled to octave dividers, will provide all of the required frequencies of the equally-tempered scale base on the 12th root of 2 and exponents thereof for as many octaves as desired. Numerical values for M and N are shown in Table 1, giving precise ratios for a scalar representation of such intervals.

TABLE 1

SINGLE AND COMPOUND RATIOS

| M | N | RATIO | CENTS | n ± 1/n RATIO |
|---|---|---|---|---|
| 18904 | 17843 | 1.05946309477 | 100.000000671 | $\frac{8}{7} \times \frac{2363}{2549}$ |
| 11011 | 10393 | 1.05946310016 | 100.000009479 | $\frac{546}{547} \times \frac{484}{456}$ |
| 7893 | 7450 | 1.05946308725 | 99.9999883831 | $\frac{9}{10} \times \frac{877}{745}$ |
| 4775 | 4507 | 1.05946305747 | 99.9999397205 | |
| 3118 | 2943 | 1.05946313286 | 100.000062913 | $\frac{8}{9} \times \frac{1559}{1308}$ |
| 1853 | 1749 | 1.05946255003 | 99.9991105287 | $\frac{17}{18} \times \frac{654}{583}$ |
| 1657 | 1564 | 1.05946291560 | 99.9997078955 | $\frac{18}{17} \times \frac{1657}{1656}$ |
| 1461 | 1379 | 1.05946337926 | 100.000465547 | $\frac{6}{7} \times \frac{487}{394}$ |
| 3544 | 2655 | 1.33483992467 | 500.000091438 | $\frac{8}{9} \times \frac{443}{295}$ |
| 2655 | 1772 | 1.49830699774 | 699.999908559 | $\frac{9}{8} \times \frac{295}{221.5}$ |

Detailed descriptions of such phase-locked-loop operation in the application of multiplier/divider ratios are given in RCA Solid State Division's Application Note ICAN-6101, printed in October 1972, p. 7, and in Solid State Scientific Inc. Application Note AN-112, published in May 1978, p. 14. There it is taught that the PLL can function as a frequency multiplier by inserting a frequency divider into the feedback loop between the VCO output and the comparator input of the PLL. Thus, the feedback modulo-M counter multiplies the frequency input to the PLL from the modulo-N counter, which divides the input frequency to the counter by N to provide a ratio of the output of the PLL to the input of the modulo-N counter of M/N.

As may be further seen in FIG. 1, any one of the tempered-scale output frequencies, but not necessarily the lowest-octave notes, may be used as a reference by switch selection for the modulation portion of this invention, comprising a phase-locked loop, PLL, and a multiplier, Q, which sets the ratio from which a number of Pythagorean fifths may be stepped progressively in 3/2 ratios, from the tonality of C♭, having seven flats, to G♭, D♭, A♭, and so on, to C; and from C to G, D, A, and so on, to C♯, having seven sharps. The Pythagorean fifths are indicated as $P_1, P_2 \ldots P_n$, and these outputs are also switch selectable to another phase-locked loop (PLL) having a multiplier, K, in the feedback loop, which provides the appropriate ratio from which the just-intonation intervals, $J_1, J_2 \ldots J_n$, are obtained, followed by octave dividers.

The just-intonation ratios, as applicable to the tonality of C alone, are shown in Table 2, which tabulates comparisons with equal-ratio intervals and lists the tempered differences in cents.

TABLE 2

COMPARISON OF INTERVALS IN CENTS

| EQUAL-RATIO INTERVALS | | JUST-INTONATION INTERVALS | | | TEMPERED DIFFERENCE | |
|---|---|---|---|---|---|---|
| C♯/D♭ | 100 | C♯ | (25/24) | 70.6724 | 29.3276 | high |
| | | D♭ | (16/15) | 111.7313 | 11.7313 | low |
| D | 200 | D | (10/9) | 182.4037 | 17.5963 | high |
| | | D | (9/8) | 203.9100 | 3.9100 | low |
| D♯/E♭ | 300 | D♯ | (75/64) | 274.5824 | 25.4176 | high |
| | | E♭ | (6/5) | 315.6413 | 15.6413 | low |
| E | 400 | E | (5/4) | 386.3137 | 13.6863 | high |
| | | E♯ | (125/96) | 456.9861 | 43.0139 | high |
| F | 500 | F | (4/3) | 498.0450 | 1.9550 | high |
| | | F♯ | (25/18) | 568.7174 | 31.2826 | high |
| F♯/G♭ | 600 | $F\sharp_G$ | (45/32) | 590.2237 | 9.7763 | high |
| | | G♭ | (64/45) | 609.7763 | 9.7763 | low |
| G | 700 | G | (3/2) | 701.9550 | 1.9550 | low |
| G♯/A♭ | 800 | G♯ | (25/16) | 772.6274 | 27.3726 | high |
| | | A♭ | (8/5) | 813.6863 | 13.6863 | low |
| A | 900 | A | (5/3) | 884.3587 | 15.6413 | high |
| A♯/B♭ | 1000 | A♯ | (125/72) | 955.0311 | 44.9689 | high |
| | | $B\flat_F$ | (16/9) | 996.0900 | 3.9100 | high |
| | | B♭ | (9/5) | 1017.5963 | 17.5963 | low |
| B | 1100 | B | (15/8) | 1088.2687 | 11.7313 | high |
| | | B♯ | (375/192) | 1158.9411 | 41.0589 | high |
| C | 1200 | C | (2/1) | 1200.0000 | | |

Reference may now be made to Table 1, which contains a columnar listing of M and N values for use in obtaining tempered-scale equal-ratio intervals for FIG. 1, and gives also each numerical decimal ratio; the equivalent in cents, an n±1/n factor of a compound ratio. Principal use will be made of the compound ratios as one means of eliminating the need for megaHertz-range master oscillators, based on the +1 and −1 modes singly, and of −1 modifiers in conjunction with binary dividers for a second means of reducing master-oscillator frequencies by combining such modifiers with all or part of the M/N functions to serve also as octave dividers. Thus the ratio-divider and octave-divider functions are combined in a single set of divider stages. The basic principles underlying the modes and modifiers are illustrated in FIG. 2, a feedforward circuit, and in FIG. 3, a feedback circuit, and are illustrated by their respective timing diagrams.

Figure 2:
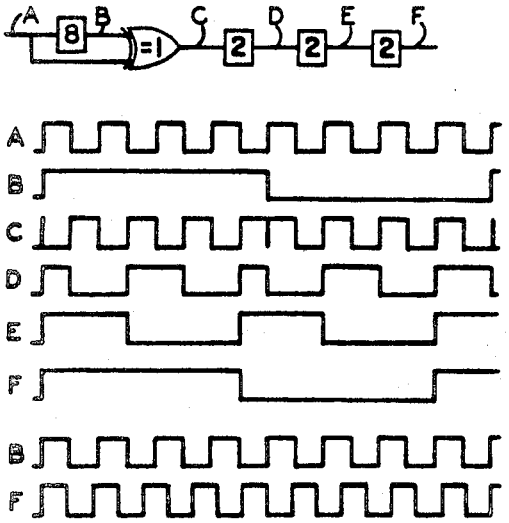
FIG. 2 is a block diagram of a circuit portion of the invention, together with a timing digram of the waveforms contained therein.

Referring now to FIG. 2, an input signal A is divided by 8, resulting in the signal at B, and both A and B signals are applied to an Exclusive-OR, or Ex-OR, gate, shown by its symbol of =1, to give a combining output at C. The operation of an Ex-OR gate is defined in the logic-symbol specifications ANSI Y32.14 of the American National Standards Institute, described in the periodical "Electronics," Dec. 7, 1978, p. 143, which states: "The output will assume its indicated active level if, and only if, only one of the inputs assumes its indicated active level." In actual operation, when the Ex-OR output goes "high" due to an appropriate signal from A it is quickly returned to its "low" state from the appropriate signal of B. A sharp pulse results therefrom which can readily be seen on an oscilloscope and is attributable to the propagation delay inherent in semiconductors, the more so in metal-oxide semiconductors, which exhibit longer delays.

As shown at C of the timing diagram in FIG. 2, there are nine transitions from low-to-high states for eight uniform input pulses at A. Division by 2, at D, only slightly improves the waveforms. Further division by 2, at E, produces periodicity, but the waveform is less than 50% duty cycle. An additional division by 2, however, at F, achieves symmetry.

If a multiple-trace oscilloscope comparison is made of the B and F outputs it will be seen that the latter has gained the time-equivalent of one of the input pulses of A. Although the timing diagram may suggest that 7 of the A pulses might be equal to the duration of the F output, the correct ratio is 7-1/9, which can be verified by measurement on a frequency-ratio meter. Moreover, lowering the oscilloscope sweep rate to display 8 pulses of B shows that 9 symmetrical pulses will be displayed for the F output, thus confirming that when followed by an equal number of divider stages to the initial divider the inherent +1 ratio of 8:9 is obtainable as a symmetrical signal. Thus it becomes possible to implement electronically what is known mathematically as a "superparticular ratio."

It should be pointed out that the foregoing +1 operation is different from the proposal of Uetrecht in U.S. Pat. No. 3,816,635 of a similar circuit to obtain one less pulse at the output than at the input during one period of the divided signal, or a −1 output.

Figure 3:
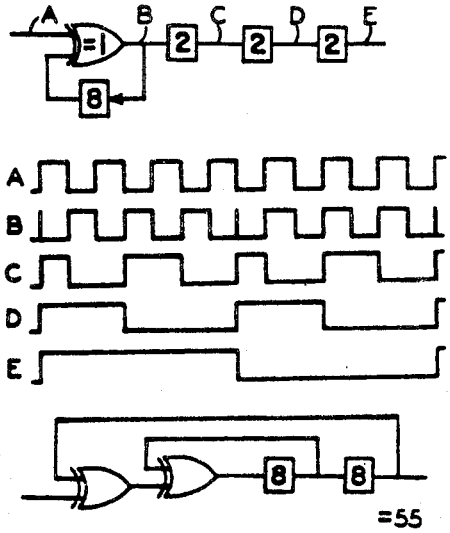
FIG. 3 is a block diagram of a second circuit portion and its corresponding timing diagram, as well as an extension of the circuit.

FIG. 3 illustrates the methods for obtaining the −1 functions as practiced in the present invention. The signal, at A, is a first input to an Ex-OR gate, a second input being obtained from the output, at B, followed by a divide-by-8 stage in a feedback circuit. This will be seen to be a symmetrical-output divide-by-7 circuit wherein the Ex-OR transition pulse advances the count within the feedback loop. The branch circuit, from B to E, shown with corresponding waveforms, also contains the accelerated pulse sequence. Therefore, identical counters connected to B and A (not shown) will provide an effective ratio of 7:8, or $\frac{7}{8}$ of an input signal at A, as will be later described in conjunction with the specific operation of the block diagram of FIG. 4.

A second use of −1 operation, also shown in FIG. 3, couples a divider output, as for example, from E, to an additional Ex-OR gate in a feedback loop ahead of and encompassing the initial Ex-OR gate and divider. Two properties result from this combination: (1) In the forward, or accumulative, direction $7\times8=56-1=55$, forming the total divisor, and (2), calculated in the backward direction, the previous division by 7 now becomes 6.875, or 55 divided by 8. Thus a series of −1 Ex-OR gates may be connected in tandem to supply cumulative encompassing feedback paths from the outputs of a series of binary dividers, also connected in tandem, to provide the modulo-N divider while retaining its binary divisions intact for use as an octave divider, except for the first several stages where the Ex-OR transition pulses occur.

Such combining of a divider, used for obtaining a desired ratio for a musical scale, with an octave divider may serve to reduce the frequency of a master oscillator by as much as the octave-divider binary number, and forms one important part of the present invention, as will be shown in the figures and description to follow.

A second important part of the present invention is the use of the compound ratios shown in Table 1, which also serves to reduce the need for a very high frequency in a master oscillator. For example, the selection of the M/N ratio of 18904/17843 for an 8-octave instrument having a lowest C of 32.7032 Hz and a highest C of 8,372.0192 Hz would require a master oscillator of 158.265 MHz if based on prior-art methods, whereas the master oscillator to be shown in FIG. 4, using the equivalent ratio in its compound form requires a frequency of 156.5 KHz, although higher frequencies may be used. Moreover, an entire scale having high accuracy of semitone ratios can not be obtained without the use of the phase-locked loop method shown in FIG. 1, wherein, further, selecting M to be larger than N causes the intervals to be of an ascending order, whereas transposing the ratio numbers for reversal of the values of M and N produces a descending scale.

Figure 4:
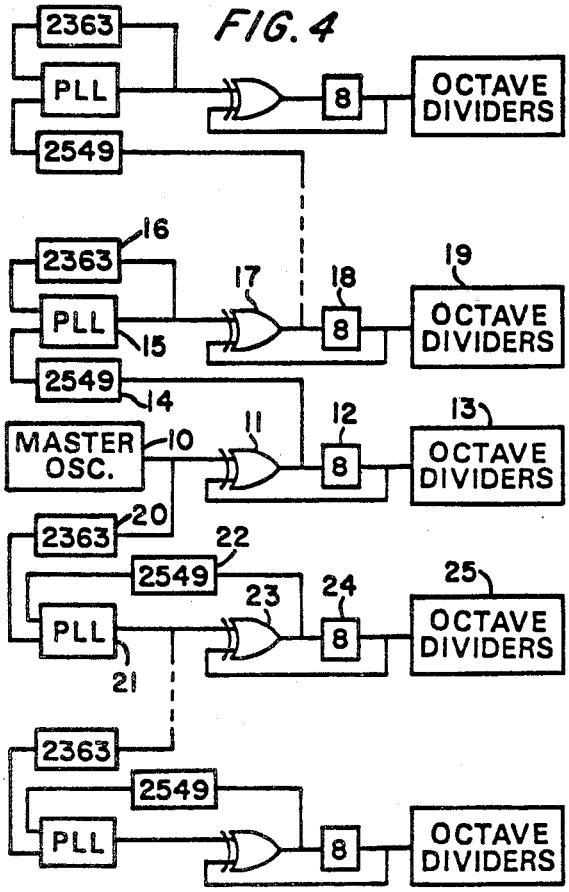
FIG. 4 is a block diagram of the equal-ratio portion of the invention, illustrating both ascending and descending scales.

Referring now to FIG. 4, a master oscillator 10 is followed by Ex-OR gate 11, which is coupled in a feedback loop from the output of a divide-by-8 stage 12, thus providing division by 7 to octave dividers 13. The output of Ex-OR gate 11 also supplies a signal to the 2549 modulo-N divider 14 in the pulse sequence shown at B of FIG. 3, resulting in a division by 2230.375, or $\frac{7}{8}$ of its nominal division, as the signal input to the phase-locked loop 15, whose output is applied to a 2363 divider 16 coupled to the comparator input of PLL 15. The locking of these input signals establishes the ratio of 2363/2230.375 at the output of PLL 15 as 1.05946309477, or 100.000000671 cents, as in Table 1. By coupling the PLL 15 to Ex-OR gate 17, its divide-by-8 stage 18 and octave dividers 19 a semitone rise results, as is true of additional similar stages.

Master oscillator 10 is also connected to the 2363 divider 20, whose output is used as the signal input to phase-locked loop 21, followed by Ex-OR gate 23, divide-by-8 stage 24 and octave dividers 25. The output of Ex-OR gate 23 is applied to the 2549 divider 22 serving as the multiplier. This supplies a division of 2230.375 to the comparator input of PLL 21 which divided by 2363 equals 0.943874312315, or 100.000000671 cents, one semitone lower than the master-oscillator frequency. Additional such stages, therefore, provide a descending scale.

Figure 5:
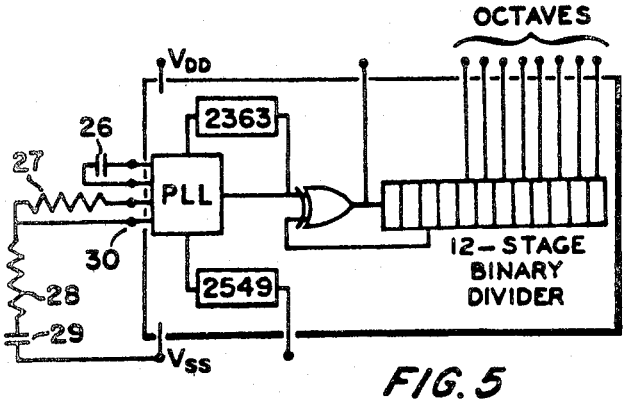
FIG. 5 illustrates one of the ascending-scale stages of FIG. 4 as applied to integrated-circuit manufacture.

FIG. 5 shows an ascending-scale element, of the type described in FIG. 4, that may be incorporated into a single integrated-circuit package of the customary 16-terminal type. Eleven such units would be used for an entire 8-octave instrument, with the first stage operating from a master oscillator (not shown) and an unmodified 12-stage binary counter for octave division. In the integrated-circuit the divide-by-8 feedback loop would be taken from the third stage of a 12-stage binary divider contained in the package also incorporating the 2549 divider, the 2363 multiplier and the phase-locked loop, the external connections for which are shown.

In FIG. 5 the capacitor 26 may be selected for the internal voltage-controlled oscillator of the phase-locked loop, to operate with a built-in resistor, for obtaining the required frequencies. The filter consists of a first resistor 27, a second resistor 28 and a filter capacitor 29, comprising a low-pass filter of the two-pole lag-lead type that is to be preferred in the event a vibrato, such as obtained from frequency- or phase-modulating the master oscillator, should be used. The junction of resistors 27 and 28 is connected to terminal 30 and is the input to the PLL's internal voltage-controlled oscillator. $V_{DD}$ and $V_{SS}$ are the plus and minus terminals, respectively, of CMOS integrated circuits.

Figure 6:
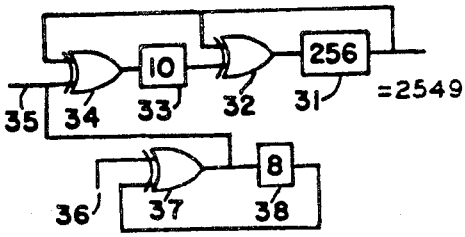
FIG. 6 is a block diagram of an alternate divider arrangement of the circuit of FIG. 4, providing octave division.

FIG. 6 illustrates how one of the dividers, namely, 2549, which was used separately either as a modified divider of a multiplier in FIG. 4, and as a divider in FIG. 5, may be further modified to incorporate some of the octave-divider stages by utilizing −1 feedback paths around single or multiple dividers. The 256 divider 31, contained in a feedback loop with Ex-OR gate 32, is reduced to 255, which multiplied by the 10 divider 33 gives 2550, and the enclosure of the two resultant dividers in a feedback loop by means of Ex-OR gate 34 reduces the total divider to 2549. The fact that the 256 divider 31 is a binary divider, despite its altered numerical division, makes it available for obtaining octaves therefrom, although the Ex-OR transitions of the early stages restrict the number to four or five octaves. Measurement with a ratio-type frequency counter shows that from the input lead 35 of Ex-OR gate 34 to the output of divider 31 the ratio is 2549 at the binary-256 output; 1274.5 at the binary-128 output; 637.25 at the binary-64 output, 318.625 at the binary-32 output, etc., having the required octave ratios of 1:2:4:8. Additionally binary dividers may be added to extend the octave range.

The 7:8 ratio utilized in FIG. 4 and in FIG. 5 is also shown in FIG. 6, where a signal applied to one input 36 of Ex-OR gate 37 followed by a divide-by-8 stage 38 whose output is connected to to the second input of Ex-OR gate 37 provides an Ex-OR gate output applied to input lead 35 of Ex-OR gate 34 whereby to change the previously described ratio of 2549 to 2230.375, also measureable on a ratio counter. The octave ratios are correspondingly lowered by the ratio of 7:8 while retaining geometric octave relationships as previously described.

In FIG. 7 a master oscillator 39 is shown connected to a succession of −1 Ex-OR gates forming a series of encompassing feedback paths for a progression of binary dividers 40 yielding a division of 273 and followed by a divide-by-2 stage 41 to give 546 in its use as an octave divider. The divide-by-two stages 42 and 43 that follow merely extend the octave divisions of a typical 12-stage binary counter. Seven useful octaves may be obtained, this limitation being due to the number of Ex-OR transitions of the earlier stages.

It will be seen (in FIG. 7) that master oscillator 39 is also coupled to a +1 Ex-OR gate 44 which has its alternate input connection obtained from the 546 division. The output of Ex-OR gate 44 thus produces the pulse sequence for providing 547/546 to the 456 divider 45 in the +1 manner previously described in the explanation of FIG. 2. Hence the ratio of the PLL 46 output to master oscillator 39, by virtue of its 484 divider 47 in functioning as a multiplier, becomes 547/546÷484/456, or 546/547×384/456, giving the ratio of 1.05946310016, as shown in Table 1. Octaves are obtainable from a 546 divider 48 identical to binary dividers 40 but here shown for simplicity as a single divider and followed by two divide-by-2 stages. Subsequent semitone stages are identical to the stage described.

FIG. 8 shows a method of utilizing a modulo-N ratio divider to supply octave divisions directly from a master oscillator 49 through a series of −1 overlapping feedback paths to provide a divisor 50 of 877 as the signal input to phase-locked loop 51. The output obtains its multiplying function through a 745 divider 52 operating as a multiplier and is applied through a divide-by-9 stage 53 to one input of Ex-OR gate 54, the other input being directly connected to the output of phase-locked loop 51, resulting in a 10/9 increase in frequency from the output of Ex-OR gate 54 to the 877 divider 55, or 10/9×745/877=0.943874319015, which is the reciprocal of 1.05946308725 shown in Table 1. Since N is larger than M the scale will be descending. In the example given, the n+1/n of 10/9 was coupled to the multiplier of 745. If the 10/9 is considered to be part of the 877 divider 55, it must be inverted to obtain the product of the two dividers, thus becoming an effective n−1/n of 9/10, or 9/10×877=789.3 as the divider to be related to the multiplier of 745, producing the same reciprocal value for a descending scale. a divide-by-9 stage 52 paralleling the direct input to Ex-OR gate 53, resulting in a 10/9 increase to the 745 divider 54 and providing a semitone decrease of 99.9999883831 cents. The 877 divider 55 as shown is a simplification of divisor 50, and the two divide-by-2 stages are octave extensions of a 12-stage binary counter.

FIG. 9 inverts the ratio of FIG. 8 to correspond to its listing in Table 1 for an ascending scale wherein the divisor 56 is now 745 and the multiplier to PLL 57 is made up of a −1 Ex-OR gate 58, followed by a divide-by-10 stage 59 and an 877 divider 60 to provide a 9/10 factor, thus making the total multiplier in the PLL feedback loop to be 877×9/10, or 789.3, which divided by 745 equals 1.05946308725, or a cents value of 99.9999883831. The 9/10 effective ratio, referred to as n−1/n, where n=10, may possibly be stated more correctly to be n−1+1/n−1 for an effective ratio of n−1/n−1+1, or the practical equivalent of n−1/n (10-1/10-1+1, or 9/10). Since M is larger than N this will give an ascending scale. The succeeding 745 divider is a duplicate of divisor 56 having the added stages for octaves.

FIG. 10 shows how a large prime number, such as 4507, may be resolved in a serial −1 encompassing-feedback manner to serve as a modulo-N divider containing octave divisions. The geometrically related octave dividers are not shown in FIG. 10 as separate binary stages, but it should be readily understandable that the divide-by-4 last stage contains two binary stages; the penultimate divide-by-8 stage contains three binary stages, the preceding divide-by-2 stage has only one binary stage, etc., and the divider ratios for obtaining the octaves, starting from the last stage, are 4507; 2253.5; 1126.75; 563.375; 281.6875; 140.84375; 70.421875, etc., or 1:2:4:8:16:32:64 as octaves.

Figure 11:
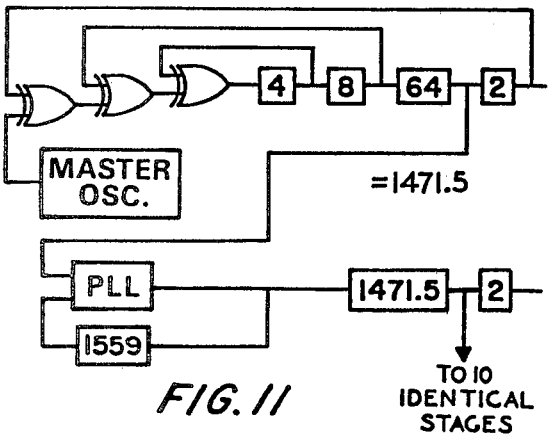
FIG. 11 is a block diagram of a half-integer divider combined with octave division.

Reference to Table 1 will show that the ratio 3318/2943 may employ the compound ratio of 8/9×1559/1308, but a preferred embodiment of the single ratio is given in FIG. 11, wherein combining the modulo-N divider with an octave divider yields yet another advantage of the dual functions, namely, the use of a half-integer divider, or divide-by-(N−½), as contained within the octave divider. This permits the PLL multiplying divider to be reduced from 3118 to 1559 for pairing with the reduction of 2943 to 1471.5. The semitone relationship gives an ascending scale of 100.000062913 cents.

Figure 12:
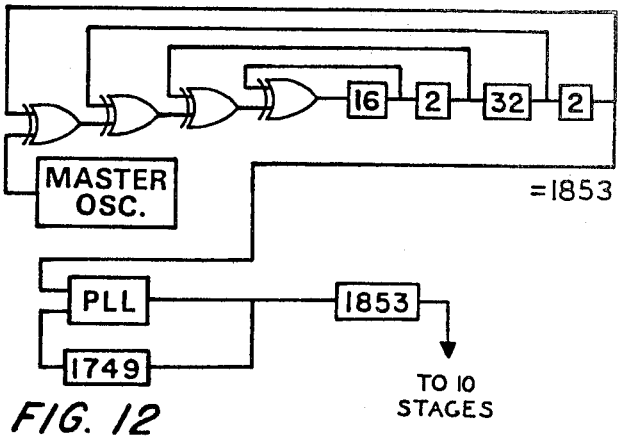
FIG. 12 is a block diagram of a single ratio where one divider supplies octave division.

Referring again to Table 1, where the ratio of 1853/1749 shows a compound-ratio equivalent of 17/18×654/583, direct use of the single ratio is preferable if for combination with octave dividers, since the −1 Ex-OR gates required are three in number instead of five for 654 or six for 583. As illustrated in FIG. 12, which contains 11 binary divider stages, a 12th may be added.

Figure 13:
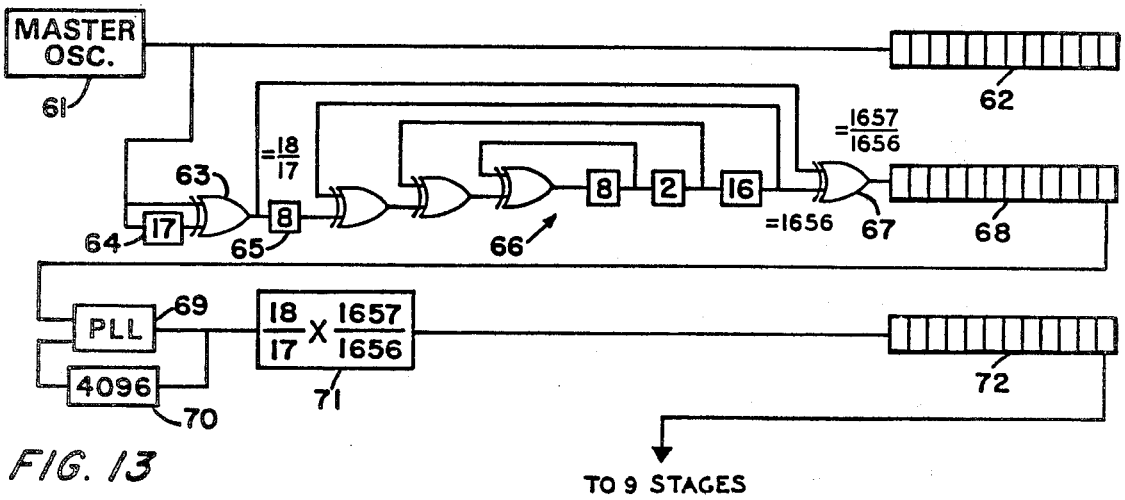
FIG. 13 is a block diagram of a compound ratio wherein each numerator exceeds its denominator by a single count.

FIG. 13 makes use of a compound ratio, 18/17×1657/1656, where each of the numerators exceeds the denominators by a single count. The first series of octave division is obtained directly from master oscillator 61 through a 12-stage binary counter 62. Master oscillator 61 also supplies its signal directly to an Ex-OR gate 63 and through a paralel divide-by-17 stage 64. The +1 output is applied to a divide-by-8 stage 65 followed by three −1 encompassing feedback stages forming the divisor 66, resulting in a division of 1656, and is fed to one input of +1 Ex-OR gate 67, the second input coming from the output of +1 Ex-OR gate 63. The multiplier outputs of each of these Ex-OR gates are shown in FIG. 13 as 18/17 and 1657/1656, respectively, and the product of the two ratios, when applied to the 12-stage binary counter 68, or octave divider, effectively yields the ratio of 1.0594629156, or 99.9997078955 cents, of Table 1. Tests have shown that a minimum of five binary-division stages will provide a useful output, thus leaving seven stages for octave dividers.

As shown in FIG. 13, the last stage of counter 68 is applied as an input signal to PLL 69, whose multiplying action is supplied by a 4096 divider 70. The PLL 69 has its output connected to a second 18/17×1657/1656 divisor 71, here shown by its compound ratio for simplicity of explanation, although in practice it is a duplicate of the previous stage. This is followed by a 12-stage binary counter 72. Since the PLL 69 operates as a unity ratio of input signal, the 4096 divider 70 may be reduced in value, for example, to as low as 128, if a similar division is taken from counter 68 for a signal input to PLL 69 and still provide seven octaves, since these may be taken from a 128 divider substituted for the 4096 divider 70. If left unchanged, the 4096 divider 70, which is an unaltered binary divider, may supply as many as 12 octaves, at the cost of adding a full such stage for a total scale.

Figure 14:
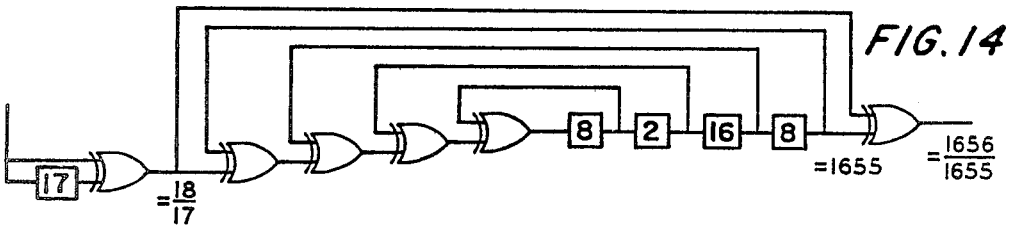
FIG. 14 is a sectional block diagram of a compound ratio which may be alternated with the ratio of FIG. 13 to improve scale accuracy.

FIG. 14 shows that an improvement in accuracy of the scale can be achieved by alternating its ratio with the compound ratio of FIG. 13 in ascending stages. The ratio of 18/17×1656/1655 will give 1.05946330193, or 100.000339184 cents. This is closely in excess of an exact semitone by as much as the FIG. 13 ratio is deficient, being 1.0594629156, or 99.9997978955 cents.

Figure 15:
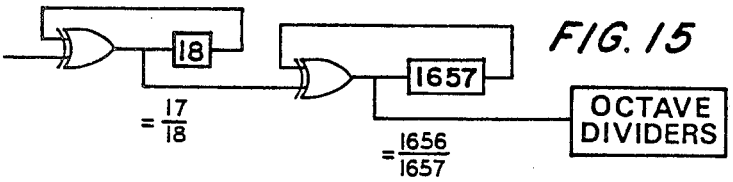
FIG. 15 is a partial block diagram for means of inverting the compound ratio of FIG. 13.

In FIG. 15 the inversion of the compound ratio of FIG. 13 is illustrated in part, and is shown in n−1/n form.

Figure 16:
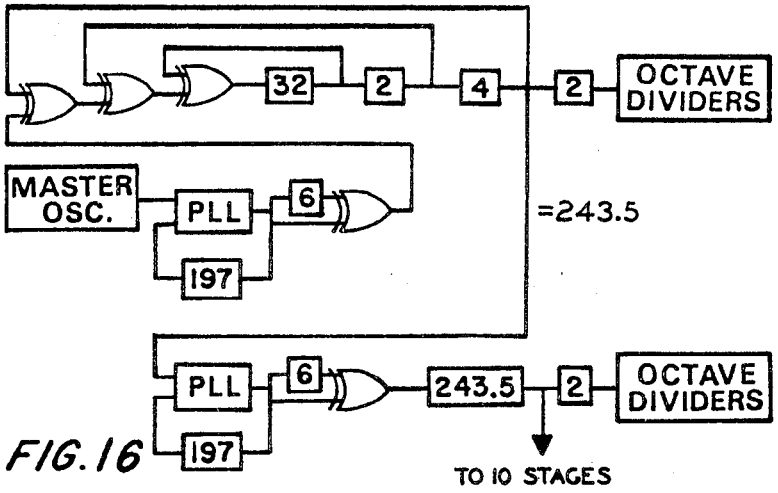
FIG. 16 is a block diagram of a compound-ratio half-integer divider operating from a low-frequency master oscillator.

FIG. 16 relates to a ratio of 1461/1379 of Table 1, wherein its compound ratio is listed as 6/7×487/394, but is utilized here as 243.5/197, or one-half of the latter values. The operation of this n+1/n circuit is similar to the description given for FIG. 8. Unlike the previous embodiments however the present master oscillator is shown as the signal input to the phase-locked loop. Although this requires an additional stage, or an added specially designed integrated-circuit unit compared, for example, with FIG. 5, it serves to make all 12 integrated-circuit packages identical. Not only is greater frequency stability obtained from the use of low-frequency operation of a master oscillator, such use also permits comparisons with other ratios, all of them connected to a single master oscillator, in testing the ear's ability to discern small differences in pitch, not only for single ratios but also for intervals in the entire scale. Such pitch-acuity tests have previously been hampered by lack of suitably accurate instruments.

Figure 17:
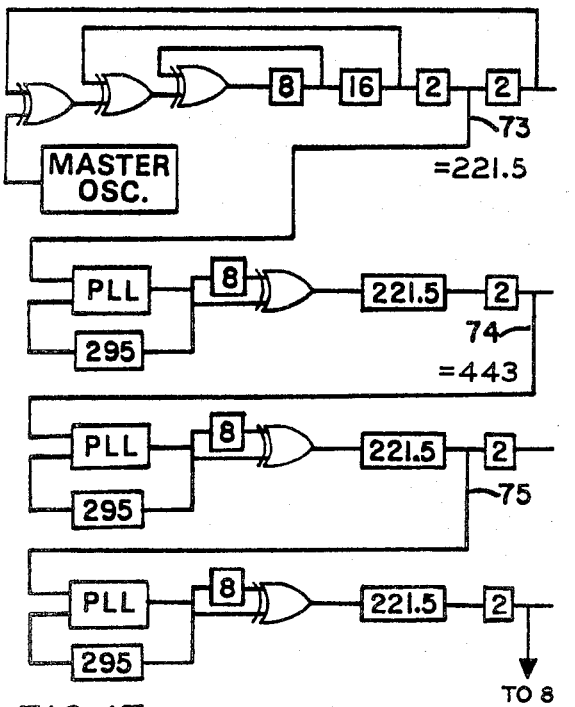
FIG. 17 is a block diagram of a compound ratio having a half-integer divider alternated with its total divider to obtain fifths and forths in a manner similar to piano and organ tuning.

FIG. 17 shows a use of the ratio of 3544/2655 of Table 1 in its compound form of 8/9×443/295 for obtaining fifths and fourths in the manner in which pianos and organs have long been tuned for equal temperament. It should be noted that Table 1 also lists 2655/1772 and its compound form of 9/8×295/221.5, which can be used in a like manner to obtain fourths and fifths.

In FIG. 17 a master oscillator supplies its signal to a series of three −1 encompassing feedback loops whose divisor provides a total division of 443. However, half of this value, 221.5, indicated as 73, is applied as a signal input to the phase-locked loop whose multiplying function is furnished by a divider of 295 and is further multiplied by a +1 Ex-OR stage identical to the one fully described in FIG. 2, yielding a multiplication of 9/8×295, or 331.875. Thus the n+1 Ex-OR gate output ratio, to the output of the master oscillator, is 1.49830699774, or 699.999908559 cents, accurate within 0.0001 cent of an equally tempered fifth. Hence if the master oscillator is set for C, the second stage at the n+1 output will give G above C. If now the output of the Ex-OR gate is applied to the entire 443 divisor of 74 for the following PLL stage, using the same multiplier of 331.875 described, the second Ex-OR gate output ratio will be 1.12246192974, or 199.999817124 cents. This is within 0.00018 cents of an equally tempered major second, and the note is D below the previous G.

Continued alternating interchange of the 221.5 divider 75 and the 443 divisor 74 for upward fifths and downward fourths may be carried to the seventh stage (not shown), where a repeated 443 divider is applied for F♯ to C♯, to avoid exceeding an octave, and is again alternated for the remaining four stages, to F, resulting in a cumulative error of 0.001 cent. Each of the 221.5–443 dividers is similar to the total divisor of the first stage, although shown in simplified form, and, as illustrated, comprises nine binary stages, although binary stages may be added for extending the octaves.

Referring now to FIG. 18, the equal-ratio outputs shown as switch positions may be obtained from any one of the foregoing embodiments of this invention. The selected note thus becomes a reference frequency enabling direct comparisons with just-intonation intervals without requiring tempered-scale transposition of the particular music as written. The reference frequency is applied to a first phase-locked loop having two switch selectable multipliers and eight dividers as parts of the modulation selector.

As shown in FIG. 18, when the two-position switch engages the 2187 multiplier, the modulation-selector positions made available range from unity, 2187 for C to 2048 for C♯ of seven sharps, each upward step corresponding to an additional sharp of the signature keys. When the two-position switch is moved to the 2048 multiplier, the same PLL dividers provide a descending order of fifths, from C, at 2048, to C♭, at 2187, with each downward step having an additional flat.

The required tonality is transferred by means of the 8-position modulation-selector switch to a second PLL, whose multiplier is 2880, which provides the resulting ratio to three sets of dividers, the first directly, the second through a multiplier of 16/15 and the third through a separate multiplier of 25/24. The basic dividers are shown with identification of each nominal note and its just-intonation ratio. Octaves (not shown) may be added to the outputs of each of the dividers or may be obtained from the dividers themselves by means of −1 Ex-OR gates in overlapping feedback paths, as was described for equal-ratio dividers, adding binary stages where needed for extension of octaves.

The just-intonation intervals shown are derived from the Ptolemaic sequence 9/8, 5/4, 4/3, 3/2, 5/3 and 15/8, which intervals are here multiplied by 16/15 to obtain the flats, where required, and by 25/24 to obtain the sharps. Although this means of obtaining sharps and flats does not appear to have been proposed previously, the separate and distinct intervals, except for E♯ and B♯, have been shown in whole or in part in various acoustical tables. (See, for example, Table I, American Standard Acoustical Terminology, Journal of the Acoustical Society of America, Vol. 14, p. 98, July, 1942; American Institute of Physics Handbook, Sec. 3, p. 106, 1957, and, particularly, The New Encyclopedia of Music and Musicians, Carl Fischer, Inc., New York, 1924, Acoustics, p. 6.)

The intervals of E♯ and B♯, which appear in written music, provide symmetry to the just musical scale in that each ascending diatonic note is followed by an augmented interval, 25/24, and by a minor second, 16/15. Moreover, the inclusion of E♯ and B♯ here provide an additional fifth; an additional major third, C♯ to E♯, and two additional minor thirds, E♯ to G♯ and B♯ to D♯, as well as a major triad, C♯-E♯-G♯ and a minor triad, C♯-E-G♯, for pairing.

Three syntonic commas (ratios of 80/81 and 81/80) are here included, and are also shown in the acoustical tables, although identified by different names. Reference may be made to Table 2 for identification of the intervals shown in FIG. 18. The interval alphabetic names and their ratios in the progressive order in which they occur in the chromatic just-intonation scale should make the need for any special terminology secondary. The intervals of "d" of 10/9 and "D" of 9/8 are a syntonic comma apart and are frequently referred to as "a small major second" and "a large major second," respectively, and the use of one is exactly equaled by the other in the variety of chords that occur in a scale, although a successive order of single notes of an ascending diatonic scale would use the "D" of 9/8. Hence it is the harmonic use of chord structures that requires any changes.

Similarly F♯ of 25/18, known as an "augmented fourth," is a syntonic comma lower than $F\sharp_G$ of 45/32 (actually this is a "borrowed" note from the tonality of G) and is the "leading" tone to modulation to the tonality of G. There are also the B♭ of 9/5 (a "minor seventh") and B♭ F of 16/9 (a "dominant seventh") borrowed from the tonality of F for modulation to that tonality. The "d" of 10/9 is also borrowed from the tonality of F, but its frequent use and interchangeability with 9/8 make necessary its inclusion in a single-tonality scale. Thus it will be seen that of the 22 separate tones shown in Table 2 for a single tonality, the three syntonic-comma tones are borrowed from adjacent tonalities.

Moreover, the total available intervals, in accordance with FIG. 18, provide for 22 tones times 15 tonalities, or 330 tones to an octave, but the modulational interrelationships account for duplication of 238 tones—the 14 additional tonalities times 17 basic notes (7 diatonic, 5 sharps and 5 flats)—so that there are actually only 92 separate tones to an octave of all the 15 tonalities.

The interval of the small "d," 10/9, historically accepted as a "mutable" note to obtain a just fifth, d to A, also serves for a just major third d to F♯; a just minor third, d to F, and just major and minor triads resulting therefrom. The F♯ of 45/32 is the "leading note" for modulating to the next tonality in the ascending order of sharps, but also forms a just major third with D of 9/8 and a just fifth with the B of 15/8. The B♭ of 16/9 is the "dominant seventh" for modulating to the next tonality in the progressive order of flats, as well as forming a just major third with G♭ of 64/45, a fifth, B♭ to F of 4/3; a major third, B♭ to d of 10/9; a minor third, B♭ to D♭ of 16/15, and the major and minor triads resulting therefrom.

The 22 intervals shwon in FIG. 18 thus meet or exceed the usually stated just-intonation requirements of 12 fifths; 12 major and 12 minor thirds, and 12 major and minor triads, by providing 16 fifths; 16 major thirds and 15 minor thirds, as well as 14 major triads and 12 minor triads within an octave of just intonation as available in each of the 15 tonalities.

Rigid adherence to the placement of the just-intonation dividers in a particular row is not a requirement. The sequence of dividers for the diatonic scale may be seen in the third row, relating to sharps, indicating that a divider of 120, for example, for G could be placed in the first row; but it is preferable to use 128, a binary number, in the second row. Similarly, 135 could be used for F in the first row, but 144 placed in the second row permits a simpler −1 encompassing-feedback octave divider of three Ex-OR gate rather than five. In addition, several of the dividers could be obtained from the multiplier of 2880, where they are directly divisible; but this would lose the advantage of using −1 feedback to obtain octaves.

The method of modifying a diatonic scale to obtain flats and sharps is shown in FIG. 18 in simplified, functional form using multipliers of 16/15 and 25/24. These may be phase-locked loops, as earlier described, wherein the denominators are dividers and the numerators are multipliers, or may be obtained by means shown in FIGS. 2 and 3, using either the +1 or −1 Ex-OR gates for signal modification in conjunction with appropriate dividers. For example, 16/15 may be obtained by the use of 16 in the feedback loop of FIG. 3 followed by four binary stages to give a symmetrical output to the interval dividers, or may preferably be used directly in its divide-by-15 symmetrical-output capability to give the identical result.

In the 25/24 multiplier requirement it is preferable to use the feedforward (+1) circuit of FIG. 2, since the number 24 is more easily made to be symmetrical than 25. Only four stages of binary division need be used, as has been found in practice, instead of five. However, interposing four-stage binary division for the flats and sharps requires a similar number of binary dividers in the first row, ahead of its interval dividers, to maintain all of the just-intonation intervals within the relationships shown. It should be pointed out that the 2880 multiplier of the second PLL may be altered, upward or downward, in binary relationship to conform to the requirements of the just-intonation intervals, as may the equal-ratio outputs be taken from an appropriate octave of intervals which provide the original reference frequencies, to maintain the comparison provisions of the present invention.

What is claimed is:

1. An electronic musical instrument comprising:

a single master oscillator frequency source serving a plurality equal-ratio stages connected in series, each of said equal-ratio stages comprising means for dividing its input frequency by N, where N is a first selected number, and means for multiplying the divided frequency by M, where M is a related second selected number, in combination whereof said first and second selected numbers form a selected M/N ratio wherein said series of equal-ratio stages provide a selected precise scalar representation of the 12th root of 2 and exponents thereof to ones of M/N-selected degrees of accuracy, the master oscillator frequency source and each of the equal-ratio stages having respective binary divider means for providing octave outputs in equal-temperament relation;

means for choosing a reference frequency from any one of said octave outputs in equal-temperament relation and applying it to a first means for multiplying the reference frequency by a predetermined value, Q, where Q is an integer, and a first group of dividers connected in parallel to said first multiplier means for providing ratios of Q to $P_1$, $P_2 \ldots P_n$, where $P_1$, $P_2 \ldots P_n$ are integer dividers each advancing the reference frequency by a successive 3/2 ratio, for transition of the reference frequency into any one of fifteen 3/2-related tonalities, and switch means for selecting a reference frequency from any one of said 3/2-related tonalities to a second means for multiplying the selected reference frequency by a factor, K, where K is an integer, a second group of parallel dividers connected to the output of said second multiplier means for providing ratios of K to $J_1$, $J_2 \ldots J_n$, where $J_1$, $J_2 \ldots J_n$ are derived from Ptolemaic intervals in just-intonation relation, each of said second group of dividers having a binary divider means for dividing the just-intonation relation ratios $K/J_1$, $K/J_2 \ldots K/J_n$ into octaves, whereby simultaneous comparisons may be made of the separately generated but similarly named equally tempered and just-intonation scales and intervals.

2. The electronic musical instrument according to claim 1 having said equal-ratio stages of said M/N multiplying means and dividing means for selected degrees of accuracy based on the 12th root of 2 of chosen ones of said selected M/N ratios whose numbers are 18904/17843; 11011/10393; 7893/7450; 4775/4507; 3118/2943; 1853/1749; 1657/1564; 1461/1379; 3544/2655, 2655/1772, and factors thereof, providing further that for any given pair of M and N numbers when M is selected to be numerically larger than N the resulting interval progression of octave outputs in equal-temperament relation will be ascending, and when M is selected to be numerically smaller than N the resulting interval progression of the octave outputs in equal-temperament relation will be descending.

3. The electronic musical instrument according to claim 2 wherein the M/N ratios and said factors thereof provide selected compound ratios each comprising at least one Exclusive-OR gate and a frequency counter for dividing the input frequency by n, where n is an integer, and combining the divided counter output frequency and the input frequency as inputs to said Exclusive-OR gate to produce a superparticular ratio as an $n+1/n$ gate output function, said selected compound ratios also comprising pairs of reversible said M/N multiplying means and dividing means whose numbers are chosen ones of compound ratios equal to $8/7\times2363/2549$; $546/547\times484/456$; $9/10\times877/745$; $8/9\times1559/1308$; $17/18\times654/583$; $18/17\times1657/1656$; $18/17\times1656/1655$; $6/7\times487/394$; $8/9\times443/295$, and $9/8\times295/221.5$.

4. The electronic musical instrument according to claim 1 wherein the transition means into 3/2-related tonalities in just intonation employs a first selectable multiplier for tonalities containing sharps in their key signatures; a second selectable multiplier for tonalities containing flats in their key signatures, and a combined modulation selector of dividers for similarly lettered tonalities from which tonalities in either sharp or flat key signatures may be selected for playing on a single-tonality keyboard.

5. The electronic musical instrument according to claim 1 wherein the divisors $J_1$, $J_2 \ldots J_n$ of said 3/2-related tonalities in just-intonation are selected to provide ratios of the Ptolemaic sequence of 9/8; 5/4; 4/3; 3/2; 5/3, and 15/8 for the diatonic intervals; including means for multiplying by 25/24 to provide intervals of a second Ptolemaic sequence in just-intonation relation for sharps, and means for multiplying by 16/15 to provide intervals from a third Ptolemaic sequence in just intonation for flats.

6. The electronic musical instrument according to claim 5 including syntonic-comma intervals of 10/9, 45/32 and 16/9 to provide just-intonation scales and intervals comprising 16 fifths; 16 major thirds; 15 minor thirds, as well as 14 major triads and 12 minor triads within the octave in any selected ones of 15 tonalities.

7. In an electronic musical instrument having a master oscillator as a primary high-frequency source, ratio dividers in the form of frequency counters relating to the selection of musical-interval ratios of a musical scale, and octave dividers in the form of binary counters:

means for combining the ratio-divider and octave-divider functions by serially connected Exclusive-OR gates of first inputs followed by a succession of divider stages of selected binary outputs as feedback paths to each of the second Exclusive-OR gate inputs from the innermost to the outermost in overlapping and encompassing engagement thereby causing each progressively resulting divider number to be decreased by a $-1$ count for obtaining a selected ratio divider while retaining the binary relationships of successive divider stages for octave-divider use intact.

8. In an electronic musical instrument having a single master oscillator for generating frequencies of predetermined scales through a series of stages, each stage multiplying the input thereto by a selected numerical ratio M/N, the combination further having an Exclusive-OR gate with one input connected to receive a signal whose frequency is multiplied by said M/N ratio, and the other input connected to receive said signal through a frequency counter having a dividing factor of n, where n is an integer, thereby generating an effective ratio of $n-1/n$ at the Exclusive-OR gate output for a frequency applied to a subsequent stage from the output of said Exclusive-OR gate, said master oscillator and each subsequent stage having octave divider means to provide an extended range of said predetermined scales.

9. In an electronic musical instrument, an improvement as defined in claim 8 wherein a phase-locked loop is employed in each stage to multiply an input signal frequency by a ratio M/N, where M has a numerical value determined by a frequency divider in the feedback loop from the output of said phase-locked loop to the comparator input thereof, and N has a numerical value determined by a frequency divider for the reference signal input of said phase-locked loop, where N may even be a noninteger determined by the effective factor $n-1/n$ of the preceding stage and the factor of its following frequency divider.

10. In an electronic musical instrument, having a single master oscillator for generating frequencies of predetermined scales through a plurality of stages connected in series, each stage multiplying the input thereto by a selected numerical ratio M/N comprising modulo-M multipliers and modulo-N dividers, the combination further having an Exclusive-OR gate with one input connected to receive a signal whose frequency is multiplied by said M/N ratio, and the other input connected to receive the output of said Exclusive-OR gate through a frequency counter having a dividing factor of n, where n is an integer, thereby yielding as $n-1$ count, the further connection to the output of said Exclusive-OR gate also providing an $n-1+1/n-1$ function in an accelerated pulse sequence whereby to advance the counting rate to each of successive ones of said plurality of stages so that they recycle their nominal count sooner than normally, thus generating an effective ratio of $n-1/n$ at the Exclusive-OR gate output for factors of $n-1/n \times M/N$ applied to a subsequent stage.

11. In an electronic musical instrument, an improvement as defined in claim 10 wherein a phase-locked loop is employed in each stage to multiply its input signal frequency by a ratio M/N, where M is a number determined by a frequency divider in the feedback loop from the output of said phase-locked loop through said Exclusive-OR gate to one input thereof, and N is a value determined by a frequency divider for its input signal, whereby M may even be a noninteger determined by the effective factor $n-1/n$ of the stage and the factor M of said frequency divider.

12. In an electronic musical instrument having a single master oscillator for generating frequencies of predetermined scales through a plurality of stages connected in series, each stage multiplying the input by a selected numerical ratio M/N, the combination for each stage comprising a phase-locked loop, a modulo-N counter for coupling an input frequency signal to the reference input of said phase-locked loop, a modulo-M counter coupling the output of said phase-locked loop to the comparator input thereof for phase comparison, and an Exclusive-OR gate having one input connected directly to the output of said phase-locked loop and the other connected through a frequency counter having a dividing factor of n, where n is an integer, whereby the ratio M/N generated by each next stage is first multiplied by the superparticular ratio $n+1/n$.

* * * * *